United States Patent [19]

Strout

[11] 4,060,437

[45] Nov. 29, 1977

[54] PANELLING METHOD

[76] Inventor: Theodore M. Strout, 24 Sharon Lane, Wethersfield, Conn. 06109

[21] Appl. No.: 780,489

[22] Filed: Mar. 23, 1977

[51] Int. Cl.[2] ..... E04F 13/00

[52] U.S. Cl. ..... 156/71; 52/457; 144/309 P; 144/309 Q; 144/313; 156/63; 428/50; 428/58; 428/191

[58] Field of Search ..... 156/63, 71; 428/50, 428/58, 191; 52/457, 417; 144/309 Q, 309 P, 313

[56] References Cited

U.S. PATENT DOCUMENTS

| | | | |
|---|---|---|---|
| 2,139,880 | 12/1938 | Colucci | 428/191 |
| 3,464,178 | 9/1969 | Deichert et al. | 156/71 |

*Primary Examiner*—Edward G. Whitby

*Attorney, Agent, or Firm*—McCormick, Paulding & Huber

[57] ABSTRACT

A panelling method comprises the steps of adhesively affixing a plurality of rectangular panels in quadrilateral abutting relationship. Adhesively backed inner stile members are affixed along vertical seams and have tabs at each end with locating notches for alignment with the seams. Adhesively backed inner rail members have tabs which enter and fit notches defined by the abutting tabs of the stile members, the rails thus being located and centered over the seams. Outer stile members are slightly narrower than the inner stile members and are adhesively bonded thereover, location of the stile members being facilitated by locating marks on the inner stile members. Outer rail members are similarly adhesively affixed to the inner rail members with the aid of locating marks. Small fillers are employed in both the inner and outer stile and rail member gaps.

7 Claims, 16 Drawing Figures

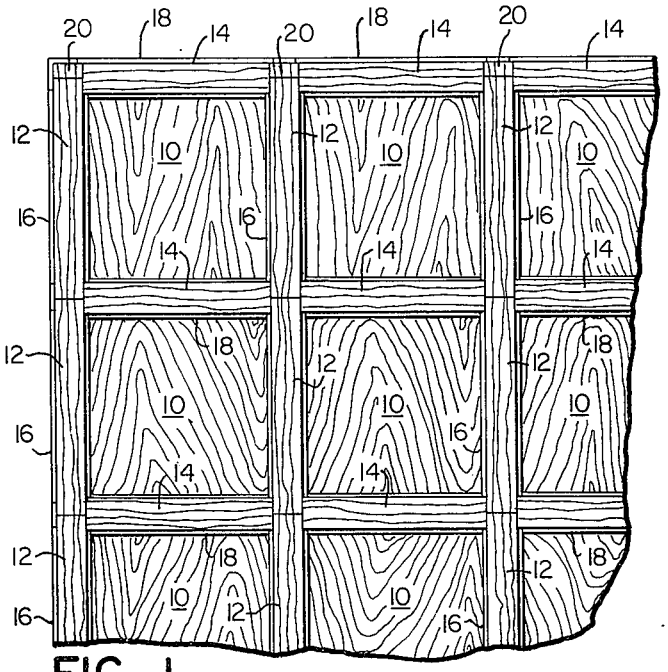
FIG. 1
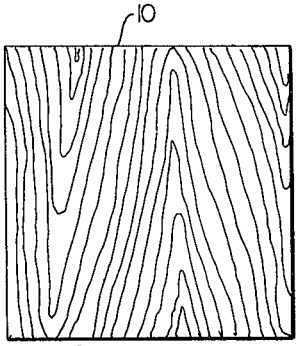
FIG. 2
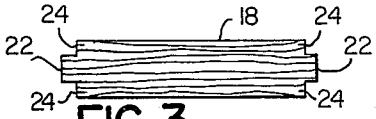
FIG. 3
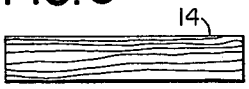
FIG. 4
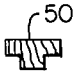
FIG. 5
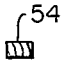
FIG. 6
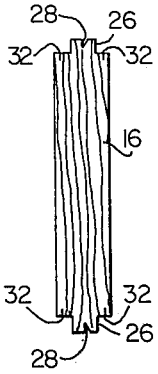
FIG. 7
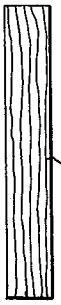
FIG. 8
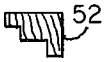
FIG. 9
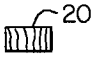
FIG. 10
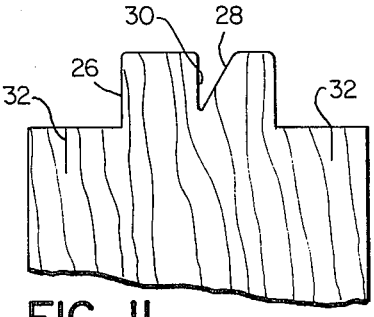
FIG. 11
FIG. 12
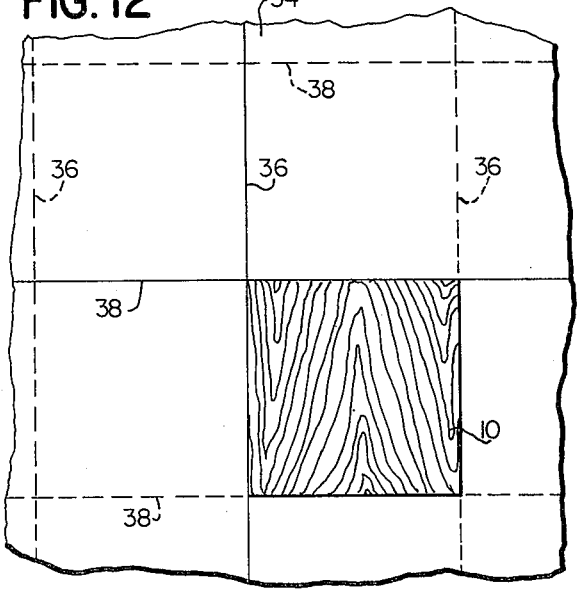

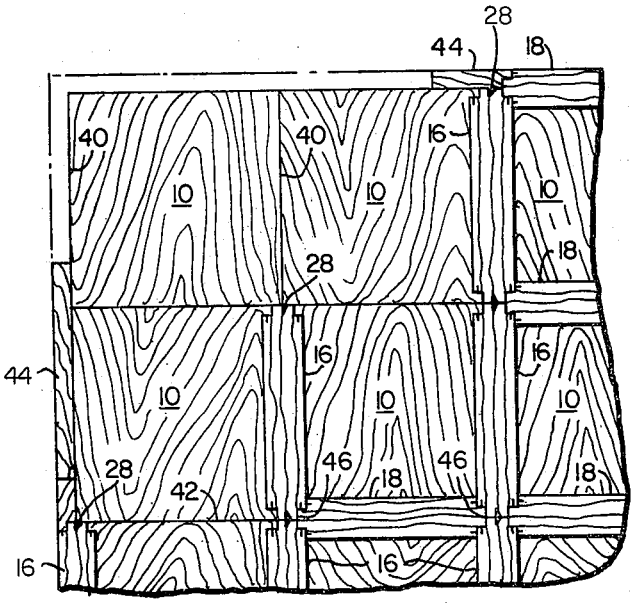
FIG. 13
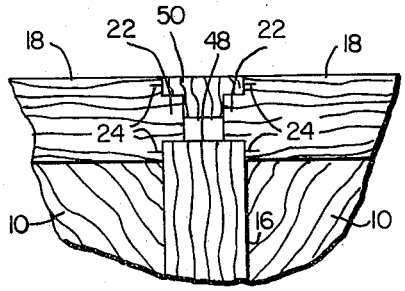
FIG. 14
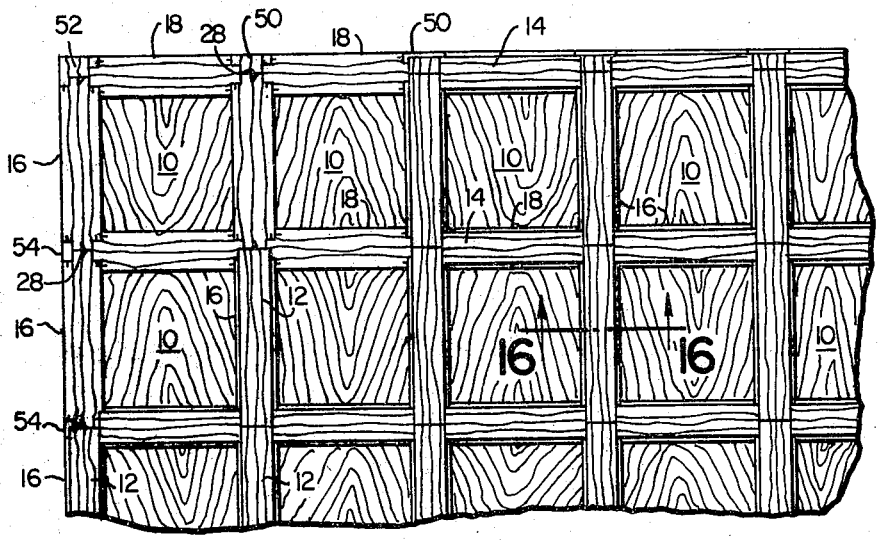
FIG. 15
FIG. 16
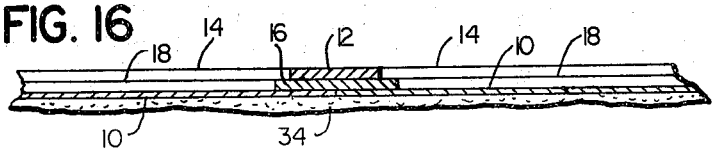

PANELLING METHOD

BACKGROUND OF THE INVENTION

Various types of panelling have heretofore been available including conventional wood construction, molded plastic, etc. Conventional wood construction is exceedingly expensive in today's market and various plastic constructions have been unsatisfactory from the standpoint of difficulty of installation, aesthetics, expense, etc.

SUMMARY OF THE INVENTION

It is the general object of the present invention to provide a method of panelling which is adapted for ease and convenience in practice by the homeowner, which is of low cost construction, and which yet exhibits pleasing aesthetic qualities.

BRIEF DESCRIPTION OF THE DRAWINGS

FIG. 1 of the drawing is an illustration of a section of panelling constructed in accordance with the method of the present invention.

FIG. 2 is a plan view of a single panel.

FIG. 3 is a plan view of a single inner rail member.

FIG. 4 is a plan view of a single outer rail member.

FIG. 5 is a plan view of a T-shaped filler used with inner rail and stile members.

FIG. 6 is a plan view of a small rectangular filler used with innter stile and rail members.

FIG. 7 is a plan view of an inner stile member.

FIG. 8 is a plan view of an outer stile member.

FIG. 9 is a plan view of a small generally L-shaped filler used with inner stile and rail members.

FIG. 10 is a plan view of a small rectangular filler used with outer stile and rail members.

FIG. 11 is an enlarged fragmentary view of an end portion of an inner stile member.

FIG. 12 is a fragmentary view of a wall or other surface with layout lines and a single panel positioned thereon.

FIG. 13 is a fragmentary view of a room wall or the like with panelling partially assembled thereon and with the inner stile and rail members overlaying panel members.

FIG. 14 is an enlarged fragmentary view showing a portion of a joint formed between inner stile and rail members in a condition where partial panels are employed.

FIG. 15 is a view of a portion of a wall with panels, inner stile and rail members applied over a portion thereof, and both inner and outer stile and rail members applied over a further portion thereof.

FIG. 16 is an enlarged fragmenatry view showing portions of two adjacent panels and both inner and outer stile and rail members affixed thereto.

DESCRIPTION OF PREFERRED EMBODIMENT

Referring particularly to FIG. 1, it will be observed that panelling constructed in accordance with the method of the present invention comprises a plurality of similar flat rectangular panels 10, 10 which are square in the embodiment of the invention illustrated and which are arranged in quadrilateral abutting relationship to cover a wall or other surface. The panels 10, 10 may vary in material of construction and may, for example, comprise wood, pressboard, and/or various plastic materials. Preferably a wood grain outer finish is provided as illustrated on the single panel 10 of FIG. 2. Further, the panels are adapted for adhesive application and a contact adhesive is preferred with a peel-off backing sheet. Thus, the homeowner or other installer may merely peel the sheet from the back surface of the panel, firmly press the panel against the wall or other surface and thus affix the panel to the surface.

Surrounding each of the panels 10, 10 as in a conventional wood panel construction, are marginal members comprising elongated outer stiles 12, 12 extending vertically and elongated outer rails 14, 14 extending horizontally. The vertical stiles or stile members 12, 12 have associated inner stile members 16, 16 underlying the same and in centered and aligned relationship therewith. Similarly, the rails or rail members 14, 14 have underlying rail members 18, 18 aligned and centered thereover. Further, it will be observed that the inner or underlying members 16, 18 are slightly wider than the outer members 12, 14 to provide a raised or stepped visual impression and thus to enhance the aesthetic qualities of the panelling. The outer surfaces of each of the members 12, 14, 16, 18 are preferably provided with a wood grain finish as best illustrated in FIGS. 3, 4, 7 and 8 or alternatively, the members may be of a thin, flat wood construction throughout. Still further, the members 12, 14, 16 18 are adapted to be adhesively secured in position and a contact adhesive is preferred as in the case of the panels 10, 10. Thus, a peel-off sheet may be provided on the back of the members, the installer may merely remove the sheet and firmly press the member in position in order to affix the same to the underlying surface.

Referring now particularly to FIGS. 4 and 8, it will be observed that a single outer rail and outer stile respectively shown therein take an elongated rectangular configuration with the stile being slightly longer than the rail. That is, the stile 12 is equal in length to one side of the panel 10 of FIG. 2 and when the stiles are in assembled position as in FIG. 1, vertically adjacent stiles are arranged in end-to-end abutting relationship. This may result in a small opening or gap at top and/or bottom portions of the panel assembly and small filler members 20, 20 are employed at these locations. As illustrated in FIG. 10, the filler members 20, 20 take a rectangular configuration and are preferably provided with a wood grain finish and an adhesive backing as in the case of the preceding elements.

The rails 14, 14 are arranged horizontally with their opposite end surfaces abutting vertical stiles 12, 12 spaced apart on opposite sides of a panel 10 whereby to complete the marginal effect about each panel.

The inner rails or rail members 18, 18, one shown in FIG. 3, are also of narrow elongated rectangular configuration and are slightly wider than the outer rails 14, 14 as mentioned. The rails 18, 18 preferably have a wood grain finish, an adhesive backing, and a centrally located tab 22 is formed at each end thereof. The tabs 22, 22 project outwardly and serve a locating and interlocking function as will be more apparent hereinbelow.

There is preferably also provided on the front surface of the inner rails 18, 18 a locating means for the outer rails 14, 14. That is, with the inner rails properly located and affixed to panels 10, 10, the rails 14, 14 may be placed thereover and precisely positioned by means of small locating marks 24, 24 at each end of the rails 18, 18. The locating marks 24, 24 are arranged to align with the outer edges of the rails 14, 14 and to insure that the rails 14, 14 are centered on and aligned with the rails 18, 18.

The inner stiles 16, 16, one shown in FIG. 7, also take a narrow elongated generally rectangular configuration, preferably include wood grain finishing on the front surface thereof, and contact adhesive backing. Each of the stiles is provided with a small tab 26 at each end thereof and the tabs 26, 26 project outwardly from the stiles 16, 16 and are centrally located laterally of the stile. The overall length of the stiles 16, 16 including the tabs 26, 26 is equal to the dimension along vertical sides of the panels 10, 10.

To assist in the installation of the stiles 16, 16 a locating means is provided on each of the tabs 26, 26 and insures proper vertical and horizontal placement of the associated stile with respect to adjacent panels 10, 10 and a vertical seam therebetween. The locating means may vary in form but preferably comprises a notch 28 which takes a generally V-shaped configuration with one straight side 30 as best illustrated in FIG. 11. The straight side 30 of the notch 28 is aligned with the longitudinal center line of the stile 16 for proper alignment and placement of the stile over a vertical seam between horizontally adjacent panels 10, 10.

Stiles 16, 16 preferably also include locating means for the outer stiles or stile members 12, 12. That is, small locating marks 32, 32 are provided at each end of each stile 16 and are so located as to align and center an outer stile 12 in overlying relationship with the stile 16. The locating marks 32, 32 align with the longitudinal edges of an overlying stile 12.

In practicing the method of the present invention, it is desirable to provide locating lines for at least one vertical and one horizontal seam on a wall surface such as 34 illustrated in FIG. 12. Thus, vertical locating lines 36, 36 and horizontal locating lines 38, 38 are illustrated. Alternatively, it may be sufficient merely to provide a point or cross mark for location of a first panel such as the panel 10 illustrated in FIG. 12. In either event panels, once properly located, are applied adhesively over the wall surface in quadrilateral abutting relationship whereby to cover the surface as required. Once applied, linear vertical seam lines such as the lines 40, 40 in FIG. 13 appear between the panels as do linear horizontal seam lines such as 42, 42. Since the marginal members comprising the stiles and rails are centered over the seam lines and in order to avoid an underlying space or gap, it may be desired to provide narrow elongated boundary strips such as 44, 44. Quite obviously, the boundary strips 44, 44 may be cut from additional panels 10, 10 and adhesively affixed in position as illustrated. Further, series of partial panels may of course occur along the side or top and bottom portions of the panelling assembly when contiguous walls, chair rails, etc. are encountered.

When the panels have been installed, members of a first group of inner marginal members such as the stiles 16, 16 may be applied. Alternatively, some or all of the members or stiles may be applied to provide a series of vertically abutting stiles along each vertical seam line 40. In affixing the stiles to the surfaces of the panels 10, 10 in proper position, the locating notches 28, 28 in the tabs 26, 26 may be employed. That is, the notches serve as sight openings and their edges 30, 30 may be aligned with the seam lines 40, 40 for precise positioning of the stiles. Similarly, the ends of the tabs 26, 26 may be aligned with the horizontal seam lines 42, 42. As will be apparent, the application of the stiles 16, 16 may be accomplished expeditiously and with a high degree of ease and convenience.

Application of the second group of inner marginal members comprising the rails 18, 18 may thereafter be readily accomplished merely by entering the tabs 22, 22 thereon in notches 46, 46 formed by the tabs 26, 26 of vertically adjacent and abutting stiles 16, 16. As illustrated in FIG. 13, the entry of the tabs 22, 22 in the notches 46, 46 automatically results in proper alignment and centering of the rails 18, 18 with the horizontal seam lines 42, 42.

Alternatively, work may progress about individual panels 10, 10. That is, stiles 16, 16 may be applied at each side of a panel 10 and thereafter rails 18, 18 applied at top and bottom portions of the panel. Proper location of the rails will be insured by utilizing the notches in the stiles. That is, the top rail can be pressed firmly downwardly to engage the lower surfaces of its tabs 22, 22 with the uppermost surfaces of the stiles 16, 16 formed at the root junction with the tabs 26, 26. A similar but reverse procedure can then be followed with the lower rail 18.

When partial panels are employed for example beneath a chair rail or other horizontal member, it is necessary to cut the associated stiles 16, 16 and this may be readily accomplished in the manner illustrated in FIG. 14. That is, the ends of the stiles may be severed to provide a straight end surface 48 adapted to abut the side edges of adjacent tabs 22, 22 of rails 18, 18. The extension of the stiles 16, 16 beyond the lower edges of the rails 18, 18 and to the lower edges of the tabs 22, 22 insures horizontal continuity of the exposed edge surface of the rails 18, 18 after application of the outer rails 14. 14. That is, if the stiles 16, 16 were severed along the lower edges of the rails 18, 18, small gaps would appear in the inner rails between the outer rail and stile edges. Similarly along the upper edge of the rails 18, 18 gaps would appear absent the use of the small T-shaped fillers 50, 50, FIGS. 14 and 5.

Referring to FIG. 15, it will be observed that fillers 50, 50 may also be employed between adjacent rails 18, 18 along the boundary of the panelling and over edge portions of full panels 10, 10. The fillers replace an end portion of a stile 16 to fill the gap which would otherwise exist. Similarly, gaps at the corners formed by a boundary stile 16 and a boundary rail 18 may be filled with the generally L-shaped members of fillers 52, 52 as illustrated in FIG. 15 and in FIG. 9. Along the side edges of the panelling and between vertically adjacent stiles 16, 16 small rectangular fillers 54, 54, FIG. 15 and FIG. 6, may be employed for a similar purpose.

With the inner stiles 16, 16, rails 18, 18 and various fillers adhesively applied and affixed over the panels 10, 10, installation of the outer marginal members or stiles 12 and 14 may commence. As best illustrated in FIG. 15, the first group of outer marginal members or stiles 12, 12 are merely aligned vertically in end-to-end abutting relationship and are centered over the stiles 16, 16 by means of the locating marks 32, 32. At upper and lower ends of the series of stiles, fillers 20, 20 may be employed.

On completion of installation of the stiles 12, 12, the second or other group of outer marginal members comprising the rails 14, 14 may be installed. As shown in FIG. 15, the end surfaces of the rails 14, 14 abut side surfaces of vertically adjacent and abutting stiles 12, 12 for horizontal placement. Vertical placement of the rails may be accomplished with the aid of the locating marks 24, 24 on the stiles 18, 18.

From the foregoing, it will be apparent that all of the outer marginal members are precisely aligned and centered over the inner marginal members and precise horizontal and vertical registry of all elements is easily achieved. The finished appearance of the panelling includes the stepped or raised profile of the stiles and rails as best illustrated in FIG. 16 and is aesthetically pleasing. Moreover, the entire installation procedure may be accomplished with a high degree of ease and convenience is substantially error-proof, may be carried out expeditiously and requires a minimal of tools, perhaps including only cutting and marking instruments and a straight edge.

I claim:

1. A method of panelling a surface comprising the steps of providing a plurality of similar flat rectangular panels each with a contact adhesive on a rear surface thereof, adhesively affixing the panels to the surface in quadrilateral abutting relationship to define continuous linear vertical and horizontal seam lines therebetween, providing first and second groups of similar narrow elongated inner marginal members each having a contact adhesive on a rear surface thereof and a centrally disposed outwardly projecting rectangular tab at each end, dimensioning said tabs so that two end-to-end adjacent and aligned members of one group define opposing rectangular notches adapted to receive and substantially fit the tabs of two aligned members of the other group when said two members of said other group are placed in perpendicular relationship with the members of said one group, providing each of the tabs of at least one of said groups of members with centrally disposed locating means, affixing members of said one group to said panels with each member overlaying a seam between adjacent panels and with the locating means on its tabs aligned with the seam, affixing members of said other group to said panels with each member overlaying a perpendicular seam between adjacent tabs on members of said one group so as to be located and aligned with the seam, providing first and second groups of similar narrow elongated outer marginal members each having a contact adhesive on a rear surface and being slightly narrower than said inner marginal members, and affixing said outer members on and respectively centered and in alignment with said inner members to provide unitary stepped marginal members about all four sides of each panel.

2. A panelling method as set forth in claim 1 wherein each of said first groups of members comprise stiles and are disposed over vertical seam lines, and wherein each of said second groups of members comprise rails and are disposed over horizontal seam lines.

3. A panelling method as set forth in claim 1 and including the step of providing locating means on a front surface of each of said inner marginal members for laterally centering the outer marginal members thereon.

4. A panelling method as set forth in claim 1 wherein the locating means on each of the tabs of said one group of inner marginal members is provided by notching said tabs.

5. A panelling method as set forth in claim 1 wherein each member of said first group of outer marginal members is provided of a length equal to one dimension of said panels, wherein said members are arranged in end-to-end abutting relationship, and wherein each member of said second group of outer marginal members is dimensioned longitudinally to fit between and in perpendicular relationship with two members of said first group disposed on opposite sides of a panel.

6. A panelling method as set forth in claim 5 wherein small adhesively backed filler members are provided and inserted in spaces at the ends of linear series of members of said first group of outer marginal members.

7. A panelling method as set forth in claim 1 wherein each of said panels and members is provided with a peel-off layer of material over the contact adhesive on its rear surface.

* * * * *